US007104088B1

(12) United States Patent
Jokinen

(10) Patent No.: US 7,104,088 B1
(45) Date of Patent: Sep. 12, 2006

(54) MACHINE FOR IMPROVING AIR CONDITIONING CONDENSER WITH MULTIPLY CAPACITIES

(75) Inventor: Teppo Kullervo Jokinen, Lake Worth, FL (US)

(73) Assignee: Teppo K. Jokinen, Lake Worth, FL (US)

( * ) Notice: Subject to any disclaimer, the term of this patent is extended or adjusted under 35 U.S.C. 154(b) by 111 days.

(21) Appl. No.: 11/233,229

(22) Filed: Sep. 22, 2005

(51) Int. Cl.
*F35B 39/04* (2006.01)

(52) U.S. Cl. ..... 62/507

(58) Field of Classification Search ..... 62/507–508
See application file for complete search history.

(56) References Cited

U.S. PATENT DOCUMENTS

| | | | | |
|---|---|---|---|---|
| 3,645,107 | A * | 2/1972 | Quick | 62/183 |
| 3,759,321 | A * | 9/1973 | Ares | 165/125 |
| 4,391,322 | A * | 7/1983 | Ciarlei et al. | 165/125 |
| 4,434,841 | A * | 3/1984 | Jackson et al. | 165/125 |
| 4,742,864 | A * | 5/1988 | Duell et al. | 165/122 |
| 5,117,656 | A * | 6/1992 | Keck et al. | 62/506 |
| 5,850,968 | A | 12/1998 | Jokinen | |
| 2005/0166630 | A1* | 8/2005 | Collins et al. | 62/428 |
| 2005/0204767 | A1* | 9/2005 | Norrell et al. | 62/298 |

* cited by examiner

*Primary Examiner*—William E. Tapolcai

(57) ABSTRACT

A machine for improving air conditioning condenser with multiply capacities with a dual compressor, a dual coil free of fins, and a bottom free of plate.

1 Claim, 3 Drawing Sheets

INVENTION
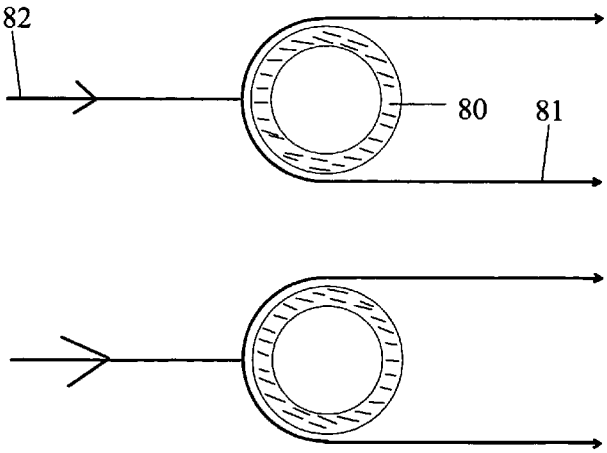
FIG. 3
CONVENTIONAL

MACHINE FOR IMPROVING AIR CONDITIONING CONDENSER WITH MULTIPLY CAPACITIES

BACKGROUND OF THE INVENTION

This invention relates generally to the field of air conditioning and more specifically to a machine for improving air conditioning condenser with multiply capacities. Under ordinary conditioning conventional air conditioners are over built that is to say that they are oversized for what they really need to be One of the drawbacks is that they are using aluminum fined coils on condensing units. Fins deteriorate very rabidly on coastal areas. repairing cost equal the price of new unit. When using single compressors on conventional residential applications, and in order to have proper cooling effect, you have to select one of the five available systems. Condensing units are made with small tubes with fins. Condensers with matching air handling units cover a certain cooling load only. Each cooling load have to have a certain capacity. Residential application requires 5–6 different capacity air conditioners. To manufacture 5–6 different size units is very costly. Also wholesalers have huge inventory. Contractors spend lot of time ordering, picking up and warehousing large quantities.

BRIEF SUMMARY OF THE INVENTION

The primary object of the invention is to provide an improved condenser for air conditioning systems.

Another object of the invention is to replace existing five different size air conditioning systems with this one.

Another object of the invention is to provide an improved outer coil free of fins.

Another object of the invention is to provide an improved inner coil free of fins Another object of the invention is to provide an improved air flow through coils of free of fins.

A further object of the invention is to provide an improved free of bottom plate.

Yet another object of the invention is to provide an improved advantage manufacturing aspect.

Still yet another object of the invention is to provide an improved environment friendly machine.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a machine for improving air conditioning condenser with multiply capacities comprising: a dual compressor, a dual coil free of fins, and a bottom free of plate.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

Figure 1:
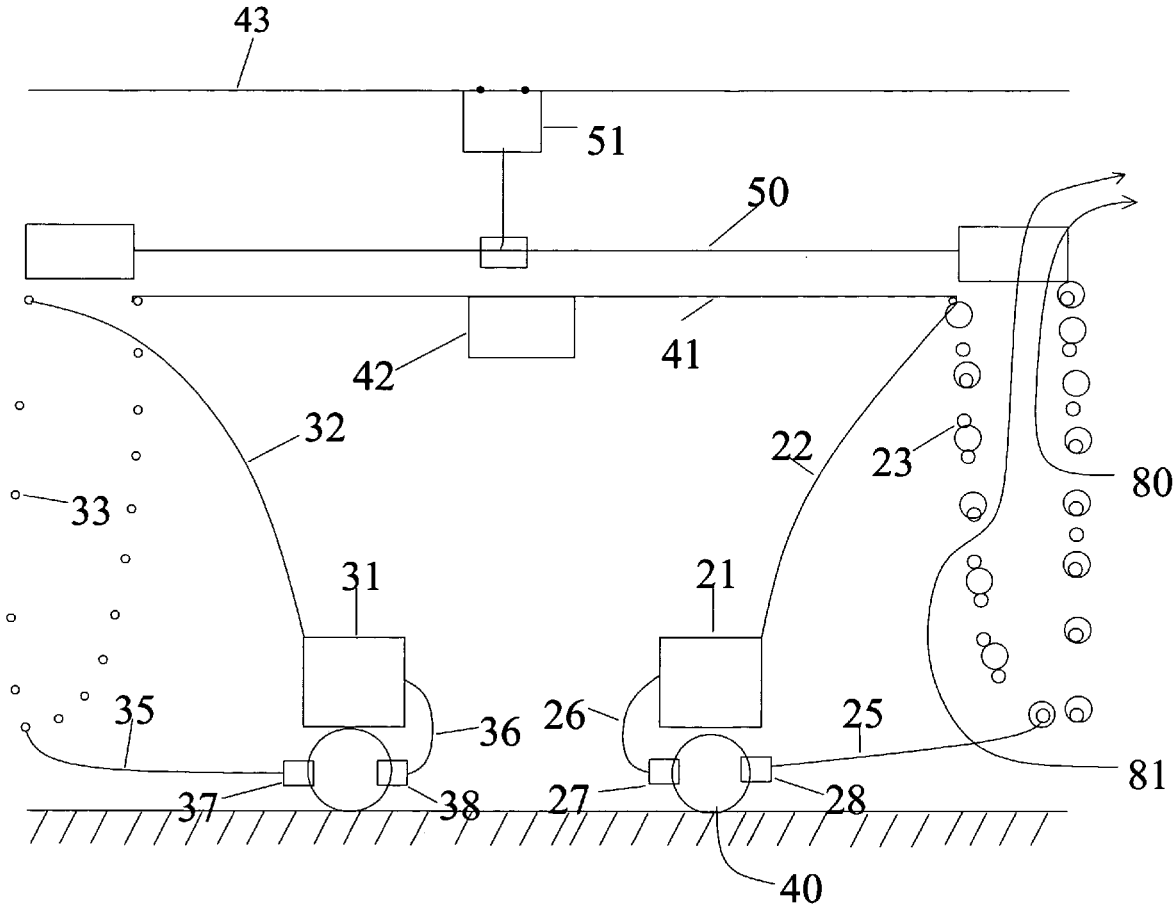
FIG. 1 is a cross sectional view of the invention

Compressors (21, 31) set above ground on PVC pipes (40). Hot gas from compressor flows through hot gas lines (22, 23) into inner coil (23) and outer coil (33). Liquid from outer coil (33) and inner coil (23) flows through liquid lines (25,35). to service valves (37,27). Gas from air handling unit flows back to compressor through service valves (28, 38). Top plate (41), forces air to go through inner coil. Motor (51) is connected to fan blade (50) to remove hot air from coils. Cover plate (43) is mounted on top of coil assembly.

Do the lower preasure in the cavity of inner coil (23) caused by running motor blades (50,51) cool outside air (81) is flowing underneat of coil assembly and then flowing thru. spaces between tubes of inner coil (23) into the cavity of outside coil (33) and inner coil (23), then upwards and outside.

Do the lower preasure in the cavity (90) of outer coil (33) and inner coil (23) caused by running motor blades (50, 51) cool outside air (80) is flowing through the spaces between tubes of the outer coil (33) into the cavity (90) of outside coil (33) and inner coil (23), then upward and outside.

Figure 2:
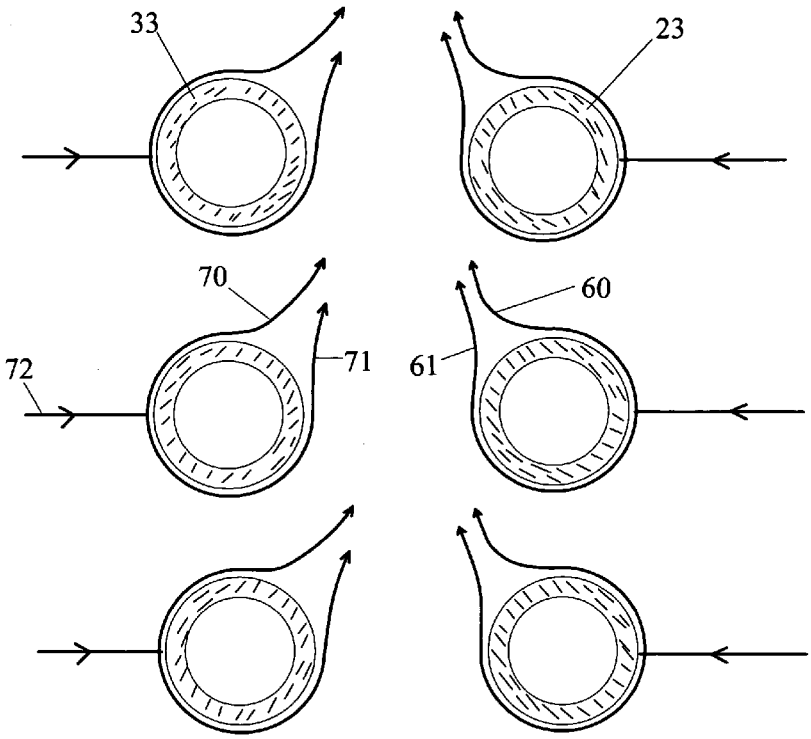

FIG. 2, is a cross sectional view of the coils (Invention).

Inner coil (23), outer coil (33) are full of hot gas. Cool air (72) from outside is flowing through opening between two tubes heat from tubes is transformed to cool air (72) Fan blade (50) is removing hot air from coil assembly.

FIG. 3, is a cross sectional view of the coils (Conventional)

Figure 4:
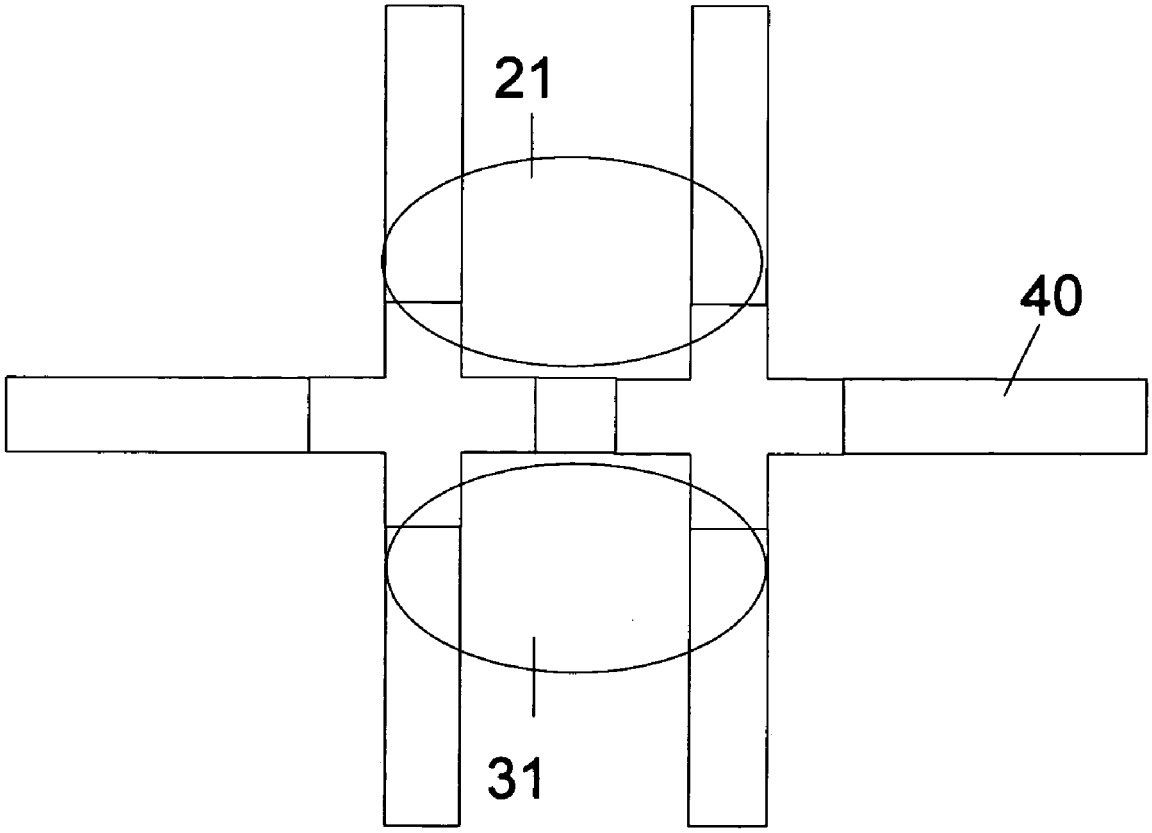

Cool outside air (82) flows through the coils (80) Heated air is removed from coil assembly FIG. 4, is a perspective view of the mounting base.

Compressors (21, 31) are mounted on PVC pipes.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

To accomplish an important function of the invention, there is shown in FIG. 1, it is to be noted that there is a dual compressor with dual independently connected dual coils free of fins.

It is noted that the compressors are mounted on PVC pipes, Instead of bottom plate so that in this way air for inner coil will flow through the coil and heat is transformed from the coil to passing air.

Attention is drawn to the fact after air flow through the coil, it turns upward and it continue touching the coil allowing the heat transform from coil to the passing air.

One of the features of the invention is the fact that heat transforms from the coil to the air have greatly increased by allowing the air touching the coil surface longer period of time.

For the purpose of the machine improving heat transform, while cost of manufacturing is reduced.

Following the preferred procedure the machine will yield multiply capacities, also comprising U.S. Pat. No. 5,850,968 air handling unit with microprocessor.

In carrying put the present invention, I provide air conditioning with low cost manufacturing, low maintenance, environmentally friendly and high efficiency machine.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

I claim:

1. A machine for improving an air conditioning condensing unit with multiple capacities comprising:

a primary compressor, a secondary compressor, a condenser comprising an inner coil free of fins and an outer coil free of fins, a bottom free of a bottom plate, a PVC pipe footing, a fan motor blade, a top plate, said primary compressor causing hot gas flowing to the outer coil free of fins;

said secondary compressor causing hot gas flowing to the inner coil free of fins;

said hot gas flowing through said outer coil free of fins, the heat of said hot gas being transferred to the passing air;

said hot gas flowing through said inner coil free of fins, the heat of said hot gas being transferred to the passing air;

said hot gas in said outer coil free of fins being transformed into a liquid;

said hot gas in said inner coil free of fins being transformed into a liquid;

said fan motor blade causing outside air to flow through said outer coil upward and out;

said PVC pipe footing causing outside air to flow underneath said condenser;

said bottom free of bottom plate allowing said outside air to flow inside said condenser;

said fan motor blade causing said outside air to flow through said inner coil free of fins; and said fan motor blade causing said outside air to flow upward and outside.

* * * * *